US007624697B1

(12) United States Patent
Toles

(10) Patent No.: US 7,624,697 B1
(45) Date of Patent: Dec. 1, 2009

(54) H2O PEDESTRIAN TRAFFIC CONE

(76) Inventor: John Louis Toles, 69 Third St., Hamden, CT (US) 06514

( * ) Notice: Subject to any disclaimer, the term of this patent is extended or adjusted under 35 U.S.C. 154(b) by 0 days.

(21) Appl. No.: 11/985,747

(22) Filed: Nov. 17, 2007

Related U.S. Application Data

(60) Provisional application No. 60/923,913, filed on Apr. 18, 2007.

(51) Int. Cl.
*E01F 9/012* (2006.01)

(52) U.S. Cl. ..... 116/63 C; 116/63 P; 404/9; 40/610

(58) Field of Classification Search ..... 116/63 C, 116/63 R, 63 P, 63 T, 209; 404/6, 9, 10; 40/612
See application file for complete search history.

(56) References Cited

U.S. PATENT DOCUMENTS

| | | | | |
|---|---|---|---|---|
| 2,719,505 | A | 10/1955 | Blumenthal | |
| 2,817,308 | A | 12/1957 | Scanlan | |
| 3,386,409 | A * | 6/1968 | Dawson | 116/63 R |
| 3,499,413 | A * | 3/1970 | Heard | 116/63 R |
| 3,792,679 | A * | 2/1974 | Duckett et al. | 116/63 P |
| 4,466,376 | A | 8/1984 | Wells | |
| 5,375,553 | A | 12/1994 | Chen | |
| 5,577,824 | A | 11/1996 | Wright | |
| 5,993,105 | A * | 11/1999 | Chan | 404/10 |
| 6,243,958 | B1 * | 6/2001 | Ringley, Jr. | 33/474 |
| 6,247,424 | B1 * | 6/2001 | Huang | 116/63 C |
| D472,490 | S | 4/2003 | Perelli | |
| 6,981,817 | B2 * | 1/2006 | Braverman | 404/9 |
| 7,003,908 | B2 * | 2/2006 | Bober et al. | 40/610 |
| 7,150,118 | B1 * | 12/2006 | Benton et al. | 40/610 |
| 7,423,552 | B2 * | 9/2008 | Sherman et al. | 340/933 |

OTHER PUBLICATIONS

Seaton Essentials Catalog, 2004, pp. CX 153, 154, 216, 217, 156. Branford, Connecticut 06 405.

* cited by examiner

*Primary Examiner*—Amy Cohen Johnson

(57) ABSTRACT

An improved traffic cone (FIG. 1) in which the base's front of the traffic cone (3) has a semicircle shape (4, 5, 6), that prevents liquid spillage from spreading from one are to another. The center of the semicircle base will vary in height and width depending on the size of the conical body. The larger the cone, the larger the base, width and height of the semicircle thus allowing the traffic cone's base to contain and prevent liquid spillage from spreading beyond the semicircle area by containing, holding and preventing the spreading of water or other liquid material.

1 Claim, 2 Drawing Sheets

H2O PEDESTRIAN TRAFFIC CONE

CROSS-REFERENCE TO RELATED APPLICATIONS

Figure 1:
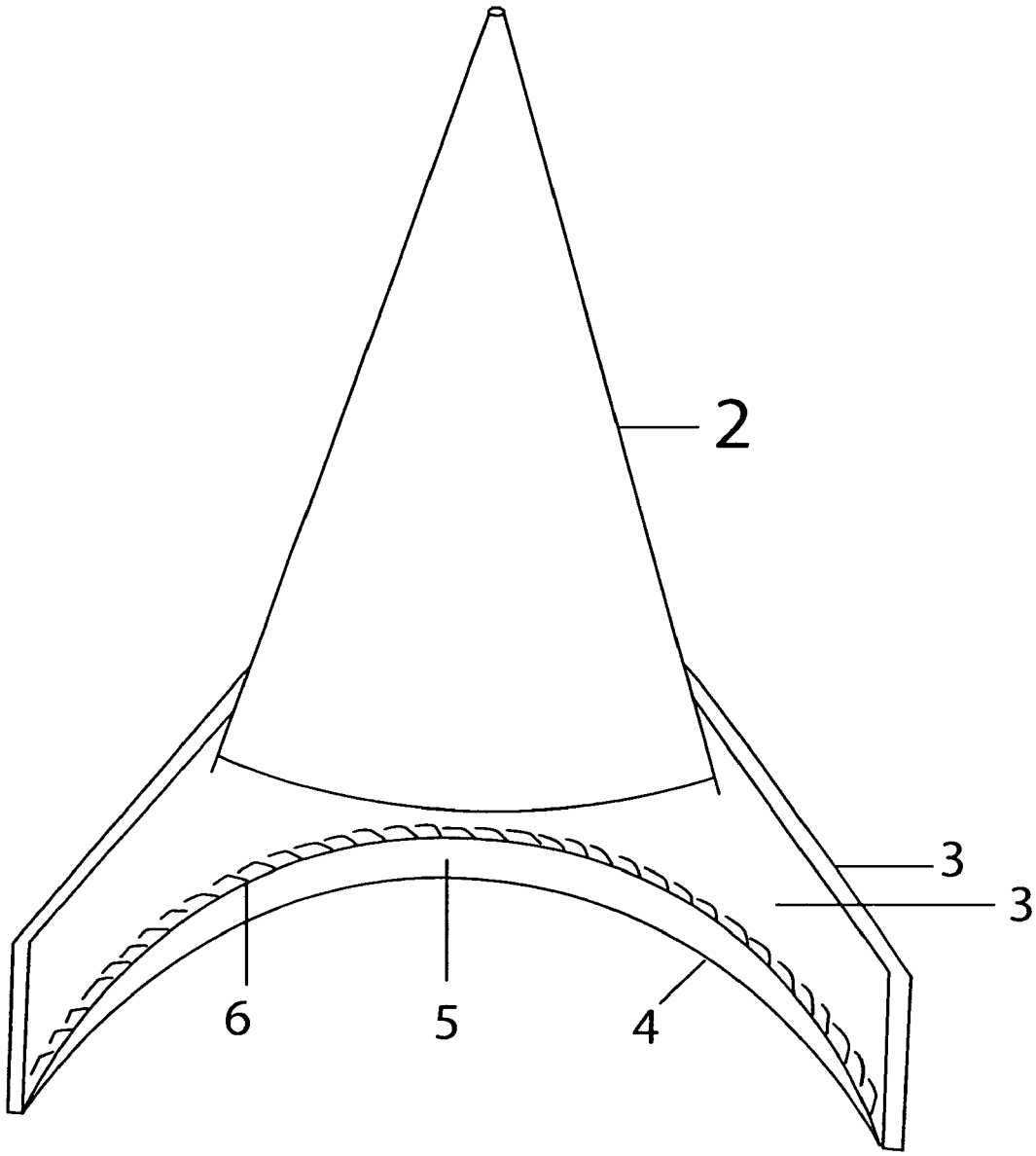

This application claims the benefit of provisional patent application Ser. No. 60/923,913, filed 2007 Apr. 18 by the present inventor.

FEDERALLY SPONSORED RESEARCH

Not applicable

SEQUENCE LISTING

Not applicable

BACKGROUND OF THE INVENTION

1. Field of Invention

This invention relates to traffic cones, specifically to improve the base of the traffic cone therefore providing a dual purpose.

2. Prior Art

In prior artwork, traffic cones are traditionally composed of a rectangular base and a conical body. Previous and current Traffic cones have a base that is primarily used for balancing the conical, the upper part of the traffic cone, and to assist in bringing attention to a hazard; but that is it, and the base serves no other purpose. The prior art traffic cones offer different heights, shapes, sizes and colors, however their purposes and intention remain the same; to provide a warning to on-coming pedestrians and motor vehicle traffic or a hazard.

OBJECTS AND ADVANTAGES

This invention, H2O Pedestrian Traffic Cone, is unlike traditional and modern traffic cones to date. It has a semicircle base that will assist in the containment of liquid spillage from a building's leaking roof or a standing puddle of water. And the upper part of the cone has a traditional conical body. Today, modern technology has grown tremendously, and so has the potential for greater hazards. The H2O Pedestrian Traffic Cone provides a complete package. Not only does it provide visibility with its height and florescent color, but it also provides that added safety by containing a certain amount of liquid spillage from one area to another. Each year there are thousands of slip and fall related injuries, and this invention will provide business and property owners with an additional measure of safety and peace of mind. And with all the day-to-day distractions, Cellular phones, I-pods and such, the general public will greatly benefit from the H2O Pedestrian Traffic Cone. It's great for maintenance workers, clean-up crews, airports, industrial sites, factories department, arenas, and any business with busy walk-ways or corridors. The H2O Pedestrian Traffic Cone can replace past and present traditional cones because of its dual purpose.

SUMMARY

This invention is an improvement to the base of the traffic cone. The base of the invention is made of a sturdy, but slightly flexible, rubber or PVC and is attached to the conical upper body as one piece, or the traffic can made entirely out of a heavier grade of PVC (Polyvinyl Chloride, which is currently used in the manufacturing of traffic cones). The base of the invention is cut to a semicircle (180 degrees) and the center of this circle has height from 5" to 36" depending on the height of the cone or width of the semi-circle base. The center of the H2O Traffic Pedestrian Cone is what makes this traffic cone unique to all past and current traffic cones. The centers height and semi-circle base assist in the containment of liquid spillage from one area to another. By containing this liquid, the invention greatly reduces the potential for slip and fall injuries. The upper area of the invention has a conical shape (18 to 50 inches in height) and is made of PVC, polyvinyl chloride, a common thermoplastic resin used in a wide variety of manufactured products, or the entire product, base and conical can be made of a heavier type of PVC (Polyvinyl Chloride). The conical area of the invention has a florescent color for high pedestrian visibility.

DRAWINGS

Figures

FIG. 1 is a perspective view from the front of the Traffic Cone.

#2 is the conical upper part of the invention made of PVC.

#3 is the top part of the base and is one piece attached to numbers 2, 4, 5, 6, and made of durable rubber, or heavy PVC.

Figure 2:
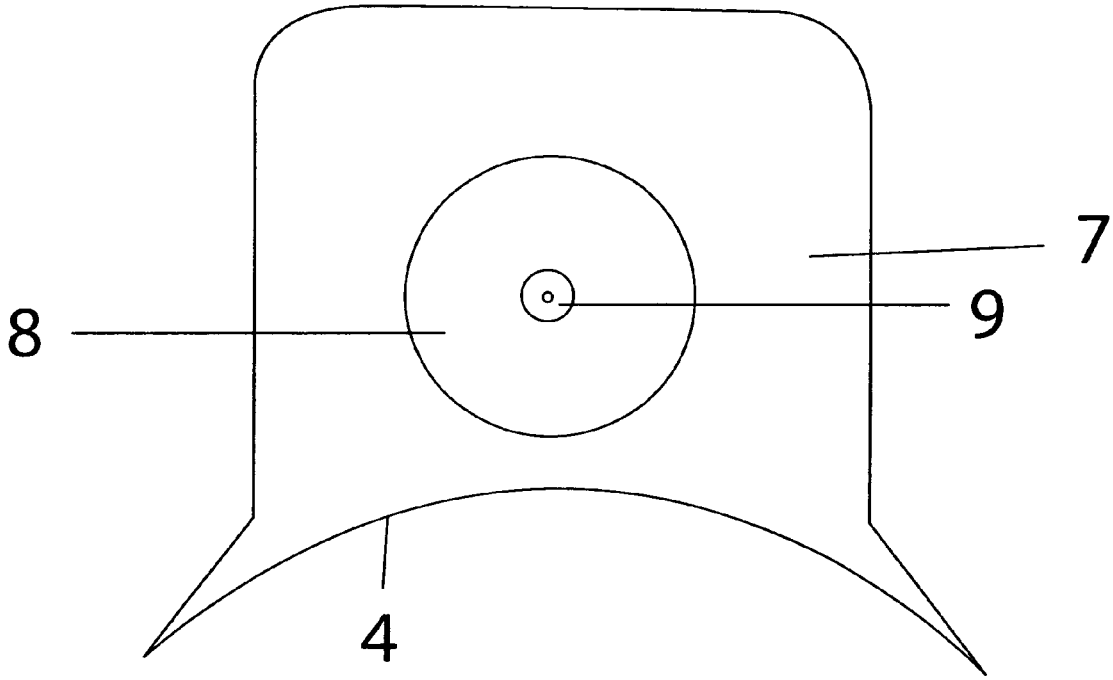

#4 is the base's bottom Line, which is level to the traffic cones square base, #7 in FIG. 2, and is also made of durable rubber, or heavy PVC.

#5 is the center section of the base, and is a wide barrier (that ranges in height from 5" to 36") will contain the liquid to keep it from spreading. The center is molded as one piece with the base but the center is raised in height according to the size and height of traffic cone. The center barrier is for the containment of liquid, or standing spillage.

#6 is the base's top Lip of the barrier, also made of durable rubber or heavy PVC.

#s 4, 5, and 6 are the semicircle base-barrier that will contain a certain amount of liquid from spreading from one area to another. This base's barrier will vary in size, length and height, depending on the height or size of the traffic cone. The larger the cone, the larger the barrier, therefore allowing the traffic cone to contain even more water from spreading.

FIG. 2 is a perspective view from the bottom of the Traffic Cone

#4 is the bottom Line of the semicircle base-barrier and is level in height to #7, allowing the traffic cone to lay flat.

#7 is the partially square base that supports the conical upper portion of the cone and the semicircle wide-base-barrier.

#8 is the inside-center of the conical shaped cone.

#9 is the top of the conical opening of the traffic cone.

DETAILED DESCRIPTION OF THE PREFERRED EMBODIMENT

FIG. 1A traffic containing an upper conical shape body, 2, and a semi-circle front base, 3, 4, 5, 6.

A center base barrier, 5, which is used to prevent or block the flow of water from spreading from one area to another.

The center barrier, 5, is supported by an upper Lip, 6, and a bottom Line, 4.

The upper Lip, 6, varies in height depending on the size of the traffic cone and acts as a barrier for rising liquid to contain and prevent the liquid from spreading over the top lip.

The bottom Line 4, prevents the liquid from spreading underneath the traffic cone and into another area. 4, 5, and 6 are permanently attached to the base of 3 and 2, as one whole unit.

FIG. 2 is a view of the traffic cone from the bottom. The partially squared base side and rear, 7, supports the entire base and conical upper body of the traffic cone, and lays flat on the ground or any flat surface. Keep in mind that you are viewing the present traffic cone from a bottom view.

The center opening of the conical body, 8, is larger center opening of the conical body.

The smaller opening, 4, is the top of the conical opening of the traffic cone.

The Base's bottom Line 4, lays flat along with the entire traffic cone's base to prevent water or liquid from spreading to another area and underneath the cone's base.

Operation—FIGS. 1 and 2

Operational usage of the H2O Pedestrian Traffic Cone is user friendly. One only has to place the cone just outside the spillage or puddle of water. By doing so, this will allow the cone to contain the liquid from spreading into another area where pedestrians are. Two cones can be used for a larger area of containment by placing the cones, with the front of their base's facing one to the other, creating a full 360 degree circle. It can be placed when an area is being cleaned, or just for directional purposes. Either way, it serves a dual purpose. The H2O Pedestrian Traffic Cone can be placed any where a potential hazard may occur.

CONCLUSION, RAMIFICATIONS, AND SCOPE

The reader will see the advantages of the invention. This invention serves two main purposes that everyone is concerned about, hazards and physical safety. The H2O Pedestrian Traffic Cone will be a welcome asset to any industry where public safety may be at risk. This invention is easy to use, and highly improves on an old product that serves only one purpose. This invention can be put to use immediately any where in the world. A traffic cone that can contain fluids from one area to another will be useful in many areas. Every business owner would welcome any extra measure of safety, and so would the insurance industries.

What is claimed is:

1. A traffic cone comprising:

a conical body; and, a base formed at a lower end of the conical body and supporting the conical body, the base comprising:

a partially squared shape comprising three sides of equal length; a fourth side of the base being semi-circular and concave; a wide band formed along the length of the semi-circular fourth side having a height so that the band forms a barrier and is adapted to prevent liquid from passing beyond the traffic cone.

* * * * *